US008870008B2

(12) United States Patent
Wu et al.

(10) Patent No.: US 8,870,008 B2
(45) Date of Patent: Oct. 28, 2014

(54) FOLDING BOX

(75) Inventors: Yu-Hua Wu, Shenzhen (CN); Ming-Chang Lee, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 24 days.

(21) Appl. No.: 13/598,652

(22) Filed: Aug. 30, 2012

(65) Prior Publication Data

US 2014/0042162 A1 Feb. 13, 2014

(30) Foreign Application Priority Data

Aug. 8, 2012 (CN) ..... 2012 1 0280253

(51) Int. Cl.
*B65D 6/00* (2006.01)

(52) U.S. Cl.
USPC ..... 220/4.28; 220/6; 220/666

(58) Field of Classification Search
CPC ..... B65D 11/18
USPC ..... 220/4.28, 6, 7, 666
See application file for complete search history.

(56) References Cited

U.S. PATENT DOCUMENTS 2,914,210 A * 11/1959 Paston ..... 220/6
4,630,745 A * 12/1986 Shiotani ..... 220/6
4,630,747 A * 12/1986 Chiang et al. ..... 220/7
4,673,087 A * 6/1987 Webb ..... 206/600
4,720,020 A * 1/1988 Su ..... 220/6
4,798,304 A * 1/1989 Rader ..... 220/6
4,834,254 A * 5/1989 Mead ..... 220/6
4,863,056 A * 9/1989 Inayama ..... 220/6
5,114,037 A * 5/1992 Hillis et al. ..... 220/4.03
5,161,709 A * 11/1992 Oestreich, Jr. ..... 220/6
5,289,935 A * 3/1994 Hillis et al. ..... 220/4.03
5,601,202 A * 2/1997 Meacham et al. ..... 220/6
5,711,444 A * 1/1998 Meacham et al. ..... 220/6
5,788,103 A * 8/1998 Wagner et al. ..... 220/6
5,865,334 A * 2/1999 Ruiz et al. ..... 220/6
5,950,836 A * 9/1999 Iwamoto et al. ..... 206/711
6,036,041 A * 3/2000 Chern ..... 220/6
6,131,757 A * 10/2000 Clark et al. ..... 220/7
6,293,418 B1 * 9/2001 Ogden et al. ..... 220/7
6,460,724 B1 * 10/2002 Bradford ..... 220/642
6,601,724 B1 * 8/2003 Koefelda et al. ..... 220/6
6,616,003 B1 * 9/2003 Polenta ..... 220/7
6,669,044 B2 * 12/2003 Murakami et al. ..... 220/6
6,776,300 B2 * 8/2004 Walsh et al. ..... 220/6
6,820,761 B1 * 11/2004 Mouri et al. ..... 220/6
6,868,979 B2 * 3/2005 Rader ..... 220/7
6,913,161 B2 * 7/2005 Schafer ..... 220/6

(Continued)

*Primary Examiner* — Fenn Mathew
*Assistant Examiner* — Christopher McKinley
(74) *Attorney, Agent, or Firm* — Novak Druce Connolly Bove + Quigg LLP

(57) ABSTRACT

A folding box includes a bottom board, two first folding board sets opposite to each other, two second folding board sets opposite to each other, and a mounting frame. Top sides of the first folding board sets are pivotably coupled to the first sidewalls of the mounting frame respectively. Bottom sides of the second folding board sets are pivotably coupled to the second sides of the bottom board. In use, the mounting frame is pulled up, bottom sides of the first folding board sets are locked to the opposite first sides of the bottom board respectively, top sides of the second folding board sets are locked to the opposite second sidewalls of the mounting frame respectively.

11 Claims, 17 Drawing Sheets

(56) References Cited

U.S. PATENT DOCUMENTS

| | | | | |
|---|---|---|---|---|
| 7,063,223 | B2 * | 6/2006 | Iwahara et al. | 220/6 |
| 7,104,414 | B2 * | 9/2006 | Apps et al. | 220/6 |
| 7,137,522 | B2 * | 11/2006 | Dubois | 220/6 |
| 7,175,040 | B2 * | 2/2007 | Lorenz et al. | 220/6 |
| 7,195,127 | B2 * | 3/2007 | Hsu et al. | 220/6 |
| 7,290,663 | B2 * | 11/2007 | Deng et al. | 206/600 |
| 7,556,165 | B2 * | 7/2009 | McDade | 220/6 |
| 7,588,156 | B2 * | 9/2009 | Lorenz et al. | 220/6 |
| 7,861,879 | B2 * | 1/2011 | Samprathi | 220/7 |
| 8,267,270 | B2 * | 9/2012 | Samprathi | 220/7 |
| 8,348,076 | B2 * | 1/2013 | Rader et al. | 220/7 |
| 2002/0092850 | A1 * | 7/2002 | Iwahara et al. | 220/6 |
| 2004/0084447 | A1 * | 5/2004 | Dubois | 220/7 |
| 2004/0222221 | A1 * | 11/2004 | Rader | 220/6 |
| 2005/0279666 | A1 * | 12/2005 | Deng et al. | 206/454 |
| 2006/0237456 | A1 * | 10/2006 | McDade | 220/6 |
| 2007/0084864 | A1 * | 4/2007 | Thrush et al. | 220/6 |
| 2007/0095825 | A1 * | 5/2007 | Tsao | 220/6 |
| 2007/0194023 | A1 * | 8/2007 | Apps et al. | 220/6 |
| 2007/0278223 | A1 * | 12/2007 | Ficker | 220/6 |
| 2008/0179322 | A1 * | 7/2008 | Parnall et al. | 220/6 |
| 2011/0056935 | A1 * | 3/2011 | Samprathi | 220/6 |

* cited by examiner

FOLDING BOX

BACKGROUND

1. Technical Field

The present disclosure relates to a folding box.

2. Description of Related Art

When storing and transporting goods, the goods are often stored in boxes for convenient classification and transportation. However, empty storage boxes can take up valuable space, thus improvement in the art is desired.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

The disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
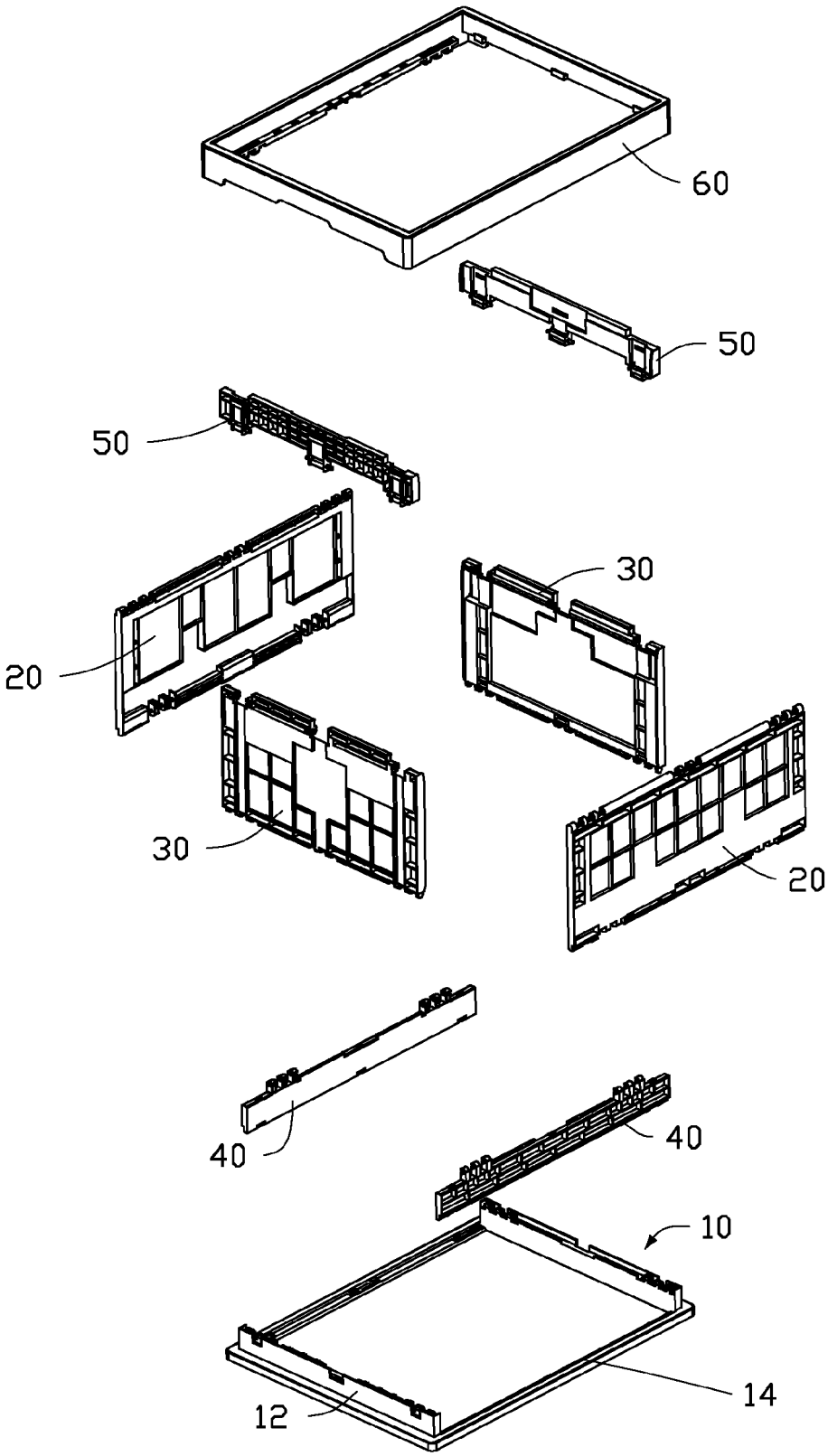
FIG. 1 is an exploded, isometric view of an embodiment of a folding box, wherein the folding box includes a bottom board, two first folding board sets, two second folding board sets, and a mounting frame.

Referring to FIG. 1, an embodiment of a folding box includes a bottom board 10, two first folding board sets, two second folding board sets, and a mounting frame 60. Each first folding board set includes a first side plate 20 (upper folding board) and a first assistant plate 40 (lower folding board) pivotably connected to the first side plate 20. Each second folding board set includes a second side plate 30 (lower folding board) and a second assistant plate 50 (upper folding board) pivotably connected to the second side plate 30. The heights of the first side plates 20 are equal to the heights of the second side plates 30. The heights of the first assistant plates 40 are equal to the heights of the second assistant plates 50. The widths of the first side plates 20 are equal to the widths of the first assistant plates 40. The widths of the second side plates 30 are equal to the widths of the second assistant plates 50. In one embodiment, the bottom board 10, the first and second folding board sets, and the mounting frame 60 are made of plastic.

Figure 2:
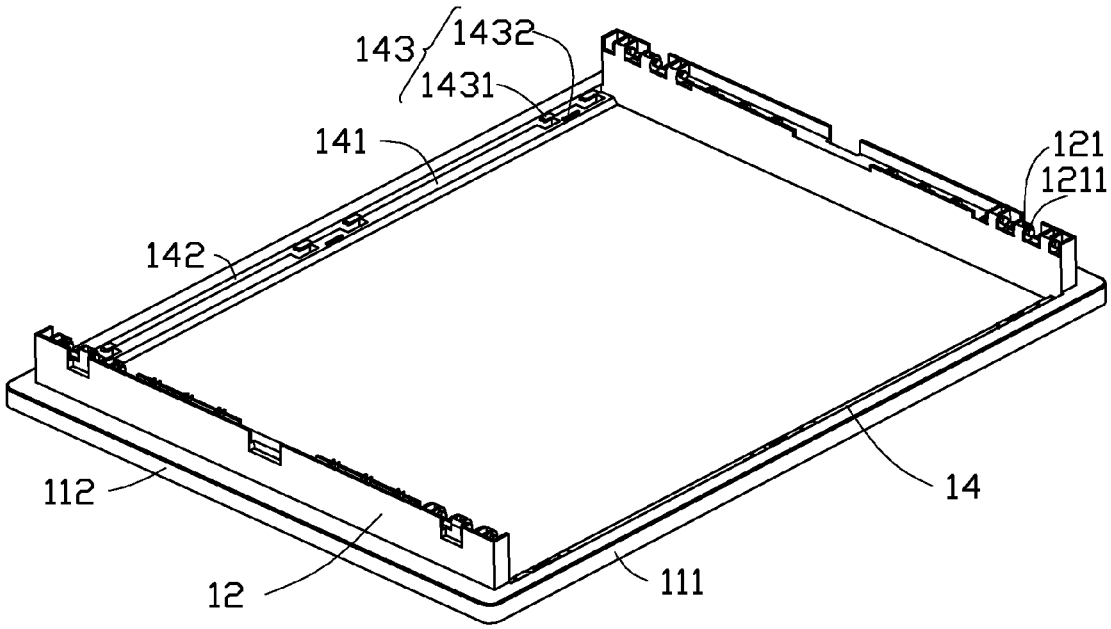
FIG. 2 is an enlarged view of the bottom board shown in FIG. 1.

Referring to FIG. 2, the bottom board 10 is a substantially rectangular plate, and includes two opposite first sides 111 and two opposite second sides 112. Two mounting plates 12 extend from the second sides 112, respectively. A plurality of raised portions 121 extends from each of two ends of the mounting plates 12 and is spaced from each other. Two pins 1211 extend from opposite sides of each raised portion 121. A stepped flange 14 extends from each first side 111. Each flange 14 includes a supporting surface 141 facing up, and a blocking surface 142 extending up from the supporting surface 141 and facing the other flange 14. Two opposite ends and a middle portion of each flange 14 each form a mounting unit 143. Each mounting unit 143 includes two blocking pieces 1431 extending in from the blocking surface 142 and a block 1432 extending up from the supporting surface 141. The block 1432 is located between the two corresponding blocking pieces 1431.

Figure 3:
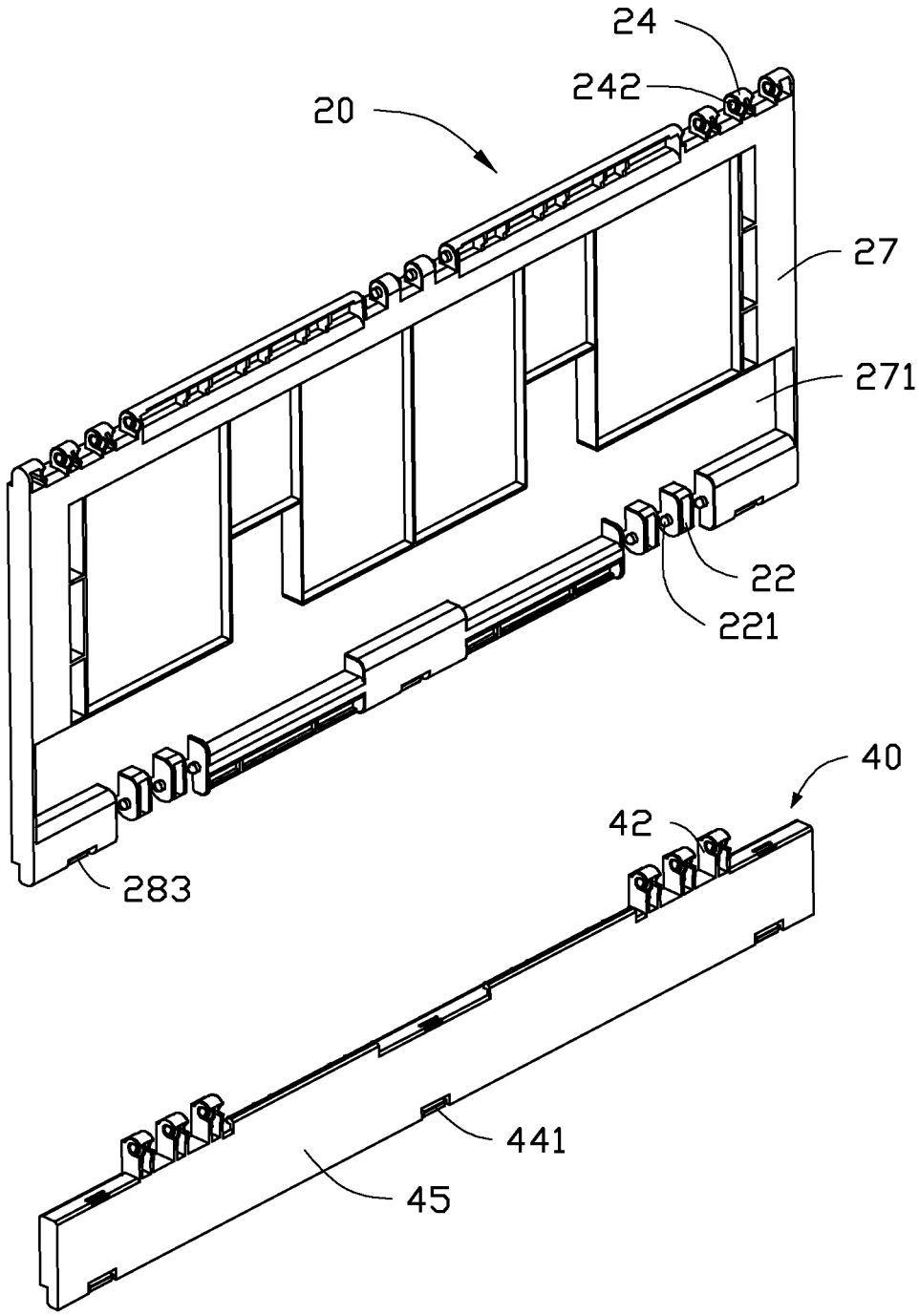
FIG. 3 is an enlarged view of one of the first folding board sets shown in FIG. 1.
Figure 4:
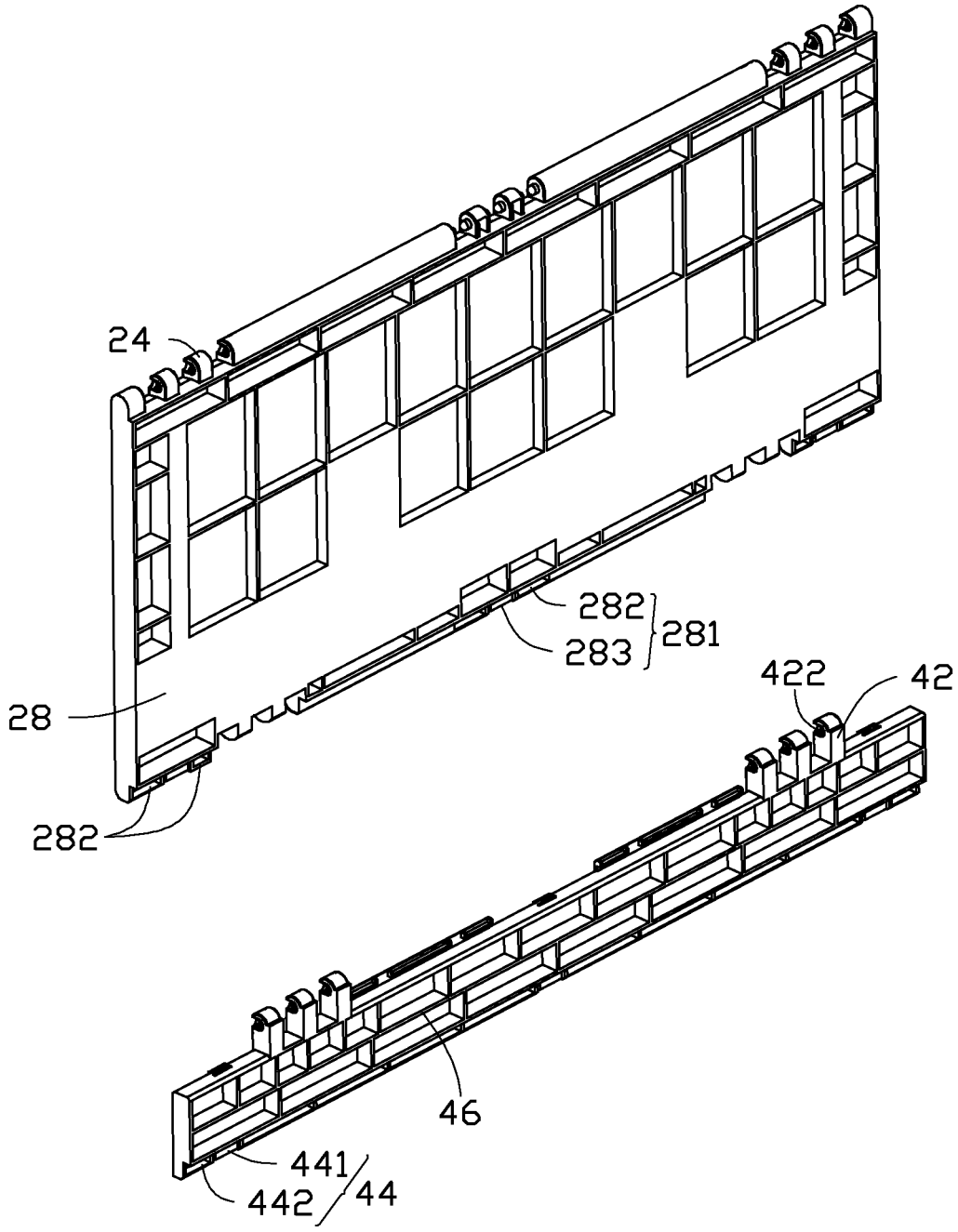
FIG. 4 is similar to FIG. 3, but viewed from another perspective.

Referring to FIG. 3 and FIG. 4, a plurality of first pivot portions 22 is formed from two ends of a bottom side of each first side plate 20 respectively. Two pins 221 extend from opposite sides of each first pivot portion 22 respectively. A plurality of second pivot portions 24 is formed from two ends of a top side of each first side plate 20. Two pivot holes 242 are defined in opposite sides of each second pivot portion 24 respectively. Each first side plate 20 includes an inner surface 27 and an outer surface 28. A receiving space 271 is defined in a lower portion of the inner surface 27. The shape and size of the receiving space 271 is suitable for receiving the first assistant plate 40. Three mounting units 281 are formed at two opposite ends and a middle portion of the bottom side of each first side plate 20, respectively. Each mounting unit 281 includes two spaced slots 282 defined in the outer surface 28 and a block 283 formed between the slots 282.

A plurality of pivot portions 42 is formed from two ends of a top side of each first assistant plate 40 respectively. Two pivot holes 422 are defined in opposite sides of each pivot portion 42 respectively. Three mounting units 44 are formed from two ends and a middle portion of a bottom side of each first assistant plate 40, respectively. Each mounting unit 44 includes a block 441 extending toward an inner surface 45 of the first assistant plate 40, and two slots 442 defined in an outer surface 46 of the first assistant plate 40 and located at opposite sides of the block 441.

Figure 5:
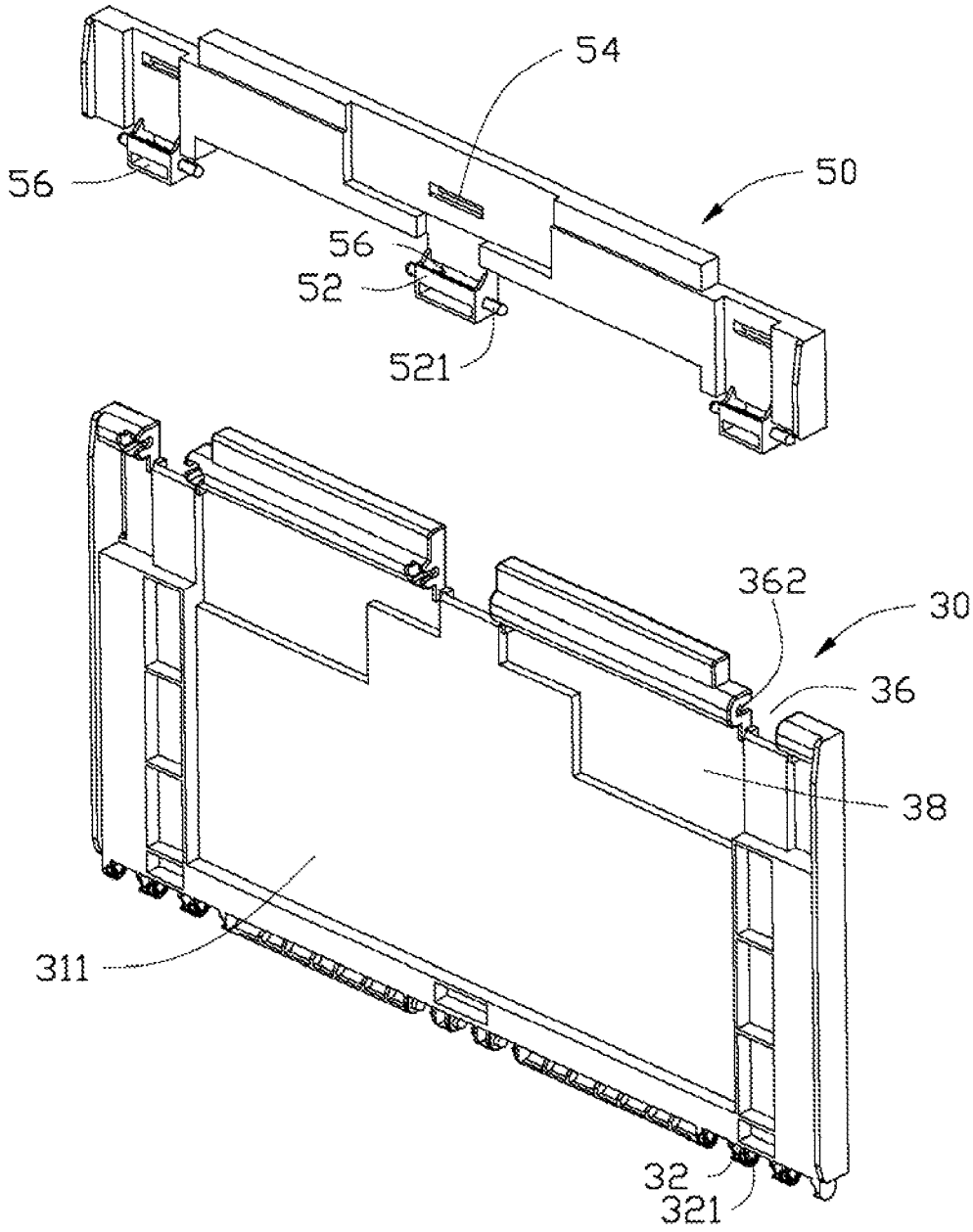
FIG. 5 is an enlarged view of one of the second folding board sets shown in FIG. 1.
Figure 6:
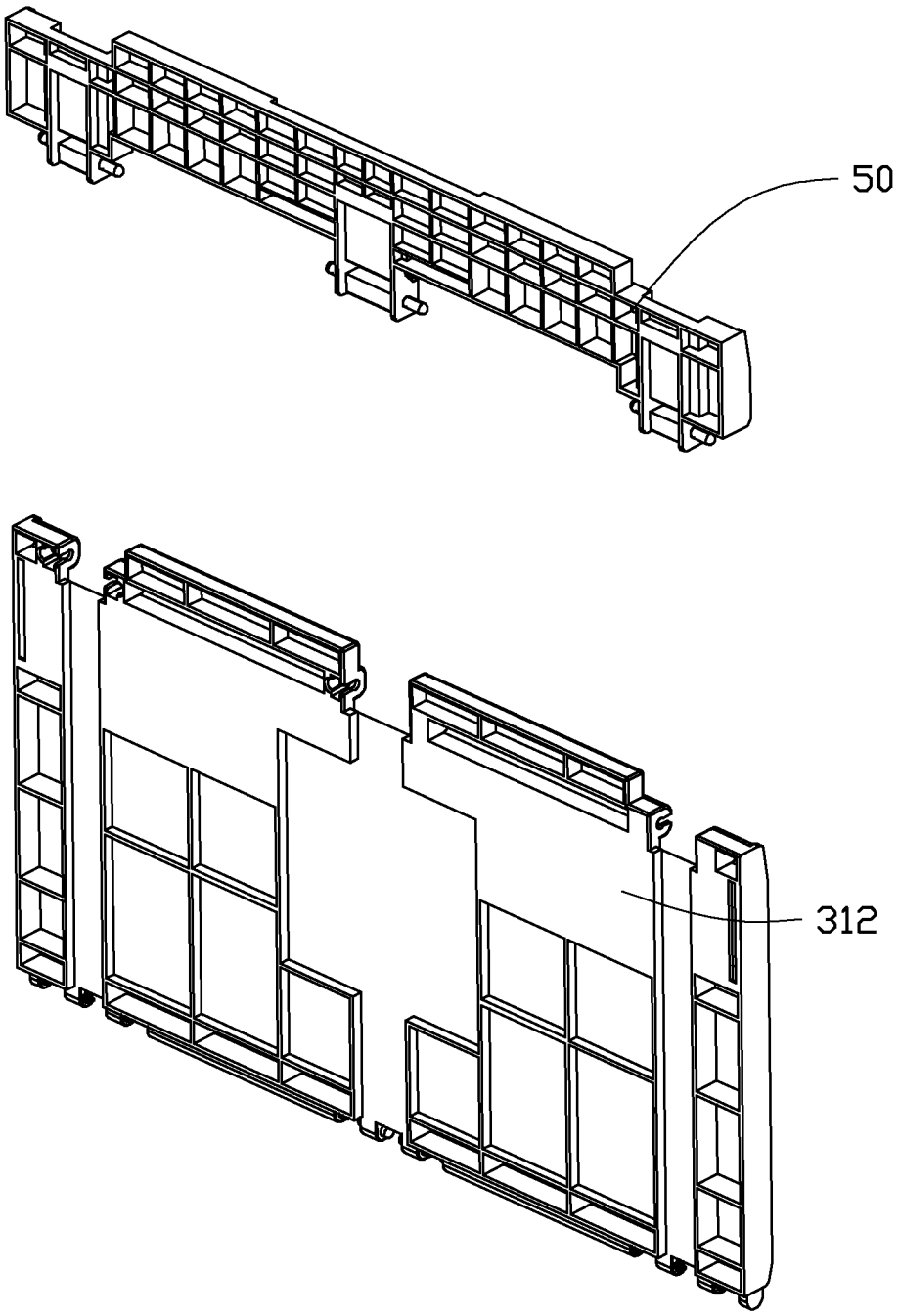
FIG. 6 is similar to FIG. 5, but viewed from another perspective.

Referring to FIG. 5 and FIG. 6, each second side plate 30 includes an inner surface 311 and an outer surface 312. A plurality of pivot portions 32 is formed from two ends of a bottom side of each second side plate 30. Two pivot holes 321 are defined in opposite sides of each pivot portion 32. Three cutouts 36 are defined in two ends and a middle portion of a top side of each second side plate 30, respectively. Two pivot slots 362 are defined in opposite sidewalls bounding each cutout 36. A receiving space 38 is defined in the inner surface 311, adjacent to the top side of each second side plate 30. The size and shape of the receiving space 38 are suitable for receiving the second assistant plate 50.

Three pivot portions 52 are formed from two opposite ends and a middle portion of a bottom side of each second assistant plate 50, respectively. Two pins 521 extend from opposite sides of each pivot portion 52. Three first locking slots 54 arranged in a horizontal line between the bottom side and a top side are defined in each second assistant plate 50. A second locking slot 56 is defined in each pivot portion 52.

Figure 7:
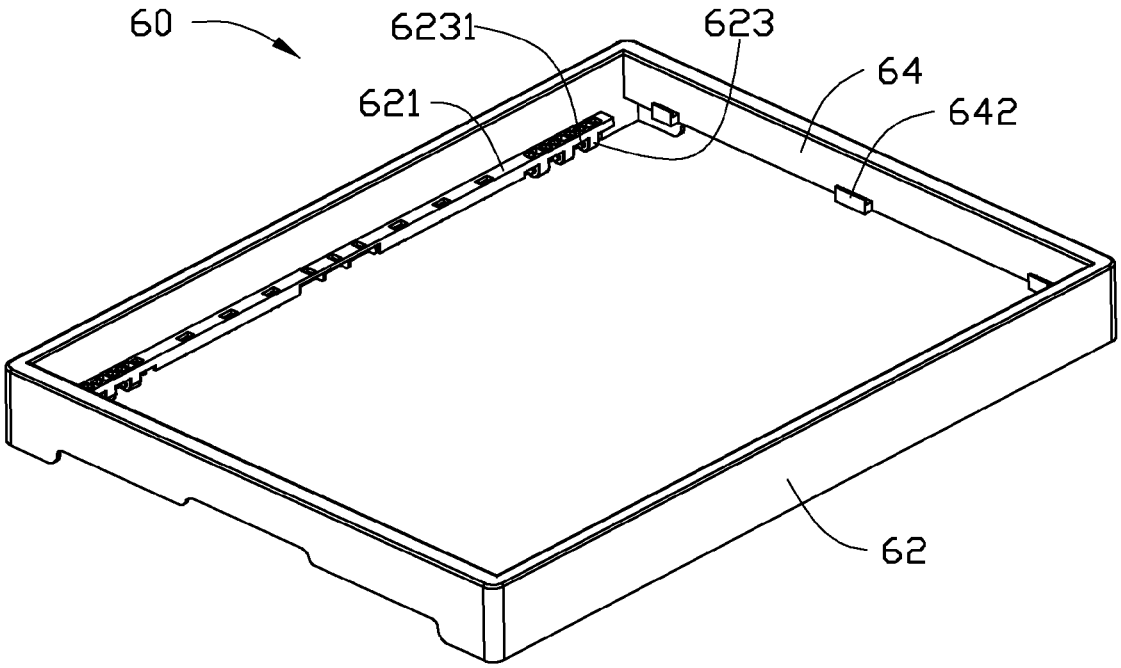
FIG. 7 is an enlarged view of the mounting frame shown in FIG. 1.

Referring to FIG. 7, the mounting frame 60 is substantially rectangular, and includes two opposite first sidewalls 62 and two opposite second sidewalls 64 connected between corresponding ends of the first sidewalls 62. Each first sidewall 62 forms a horizontal bar 621 from an inner surface of the first sidewall 62. The bar 621 includes a plurality of locking portions 623 extending down from opposite ends of the bar 621. Two pins 6231 extend from opposite sides of each locking portion 623. Three blocks 642 are formed on two ends and a middle portion of an inner side of each second sidewall 64.

Figure 8:
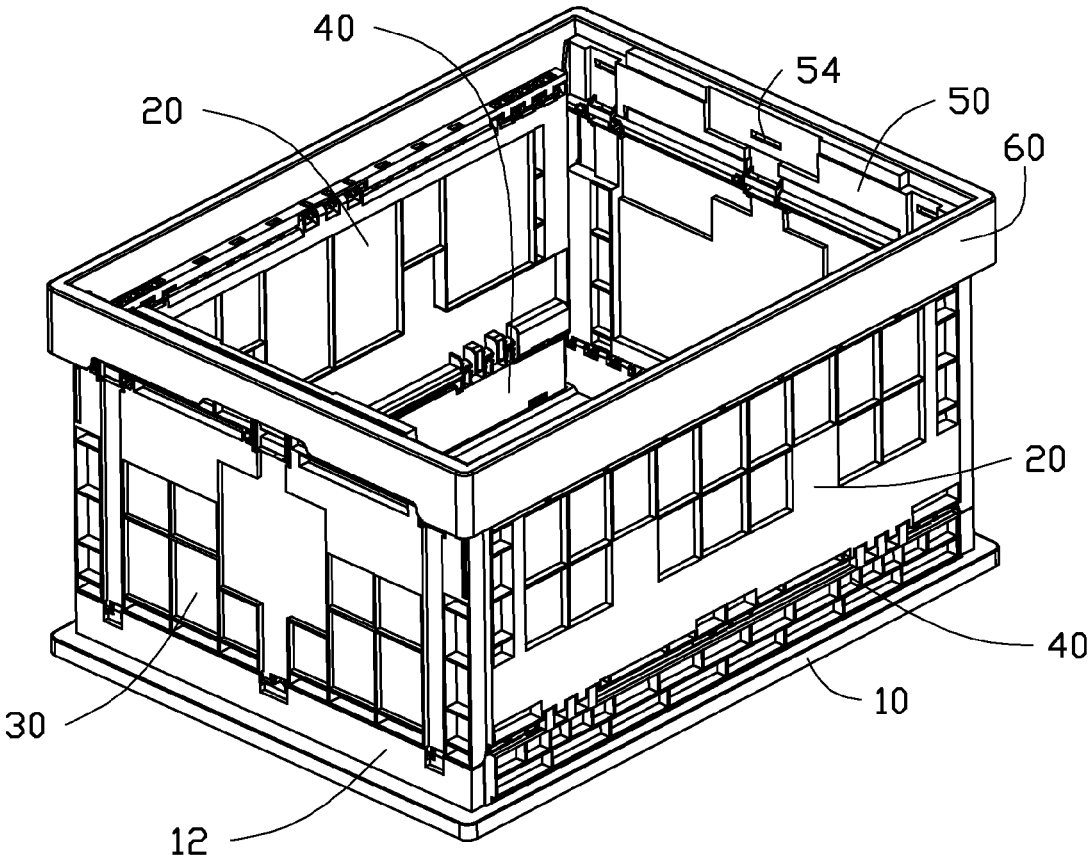
FIG. 8 is an assembled, isometric view of FIG. 1, showing a first height of the folding box.
Figure 9:
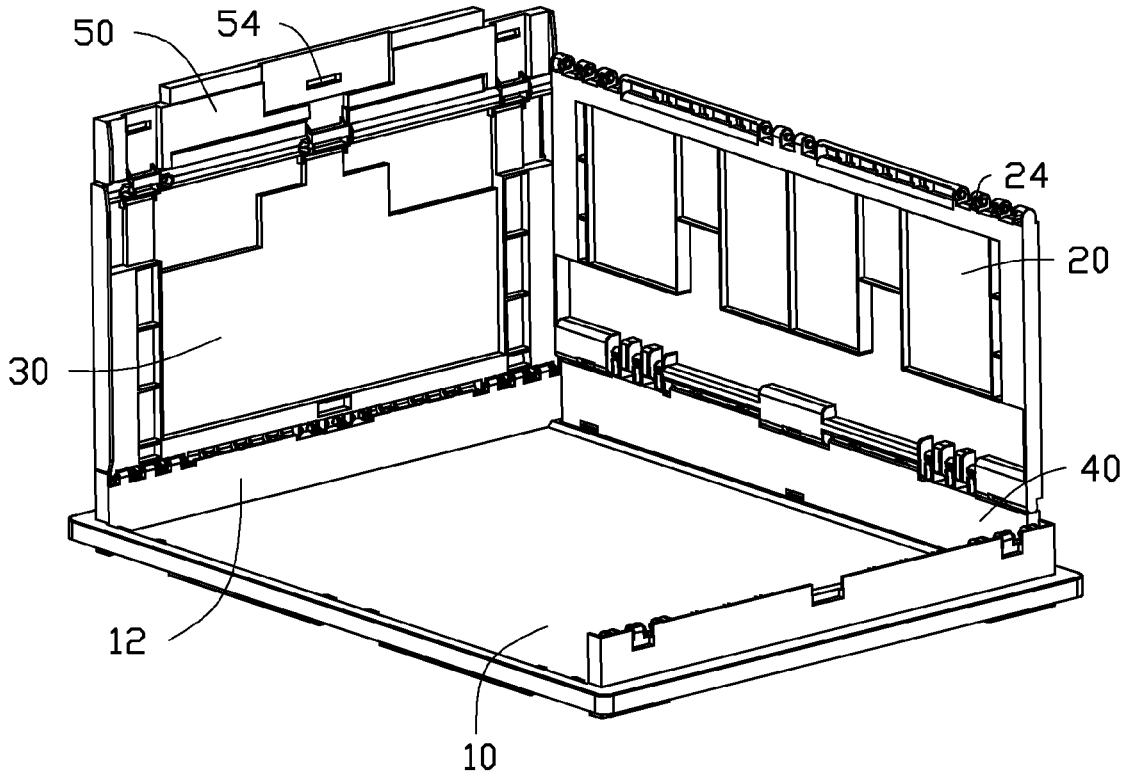
FIG. 9 is a partial view of FIG. 8.
Figure 10:
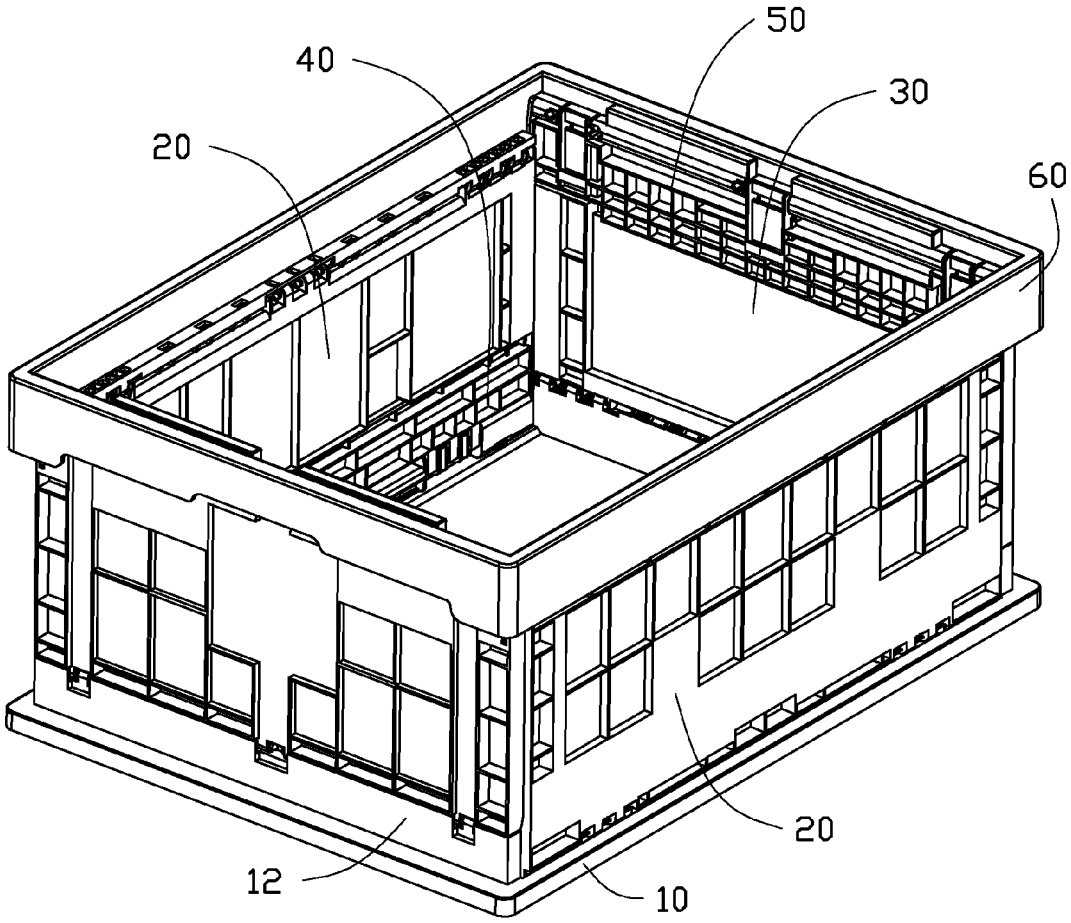
FIG. 10 is an assembled, isometric view of FIG. 1, showing a second height of the folding box.
Figure 10A:
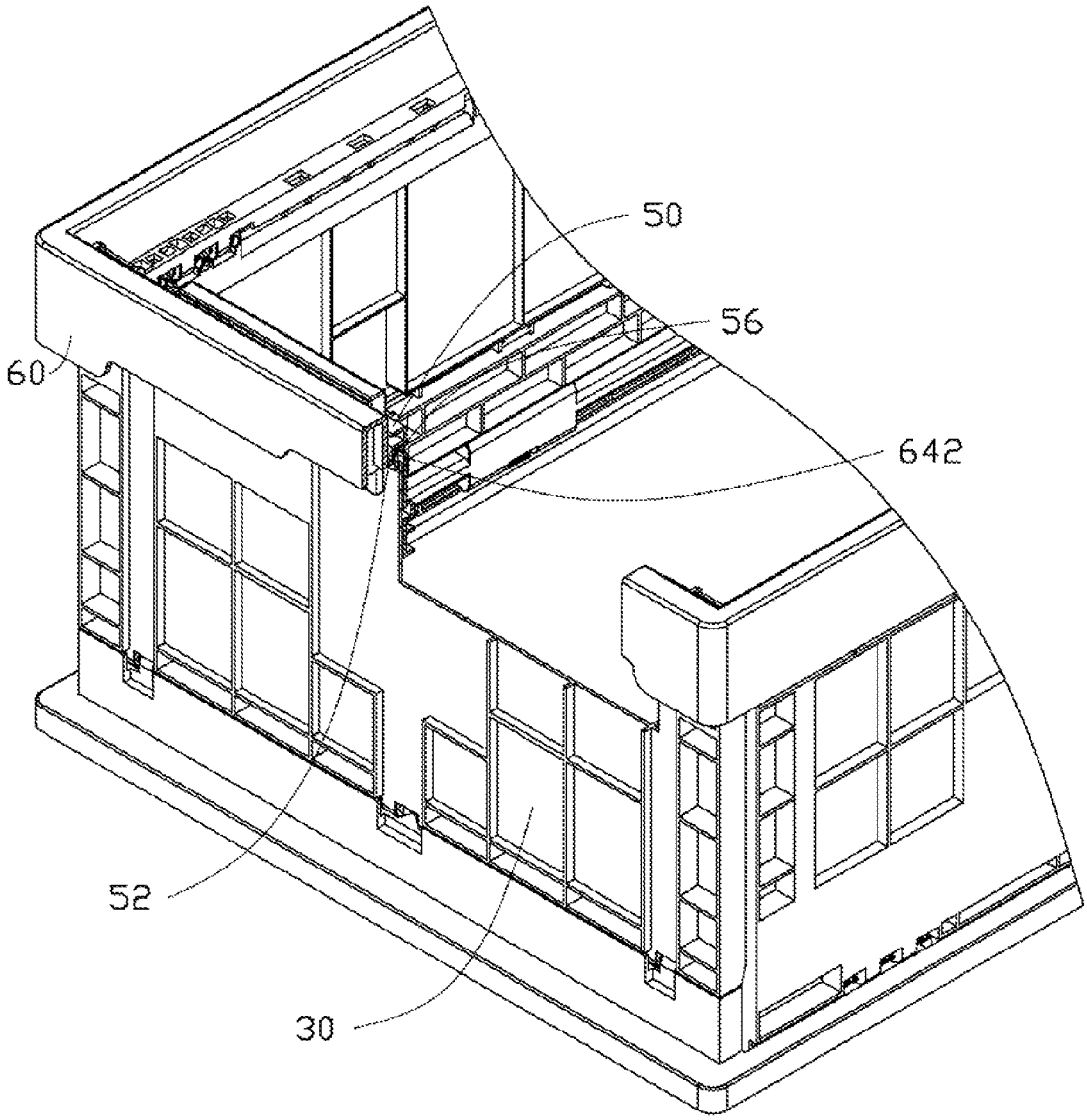
FIG. 10A is a partial section view of FIG. 10.
Figure 11:
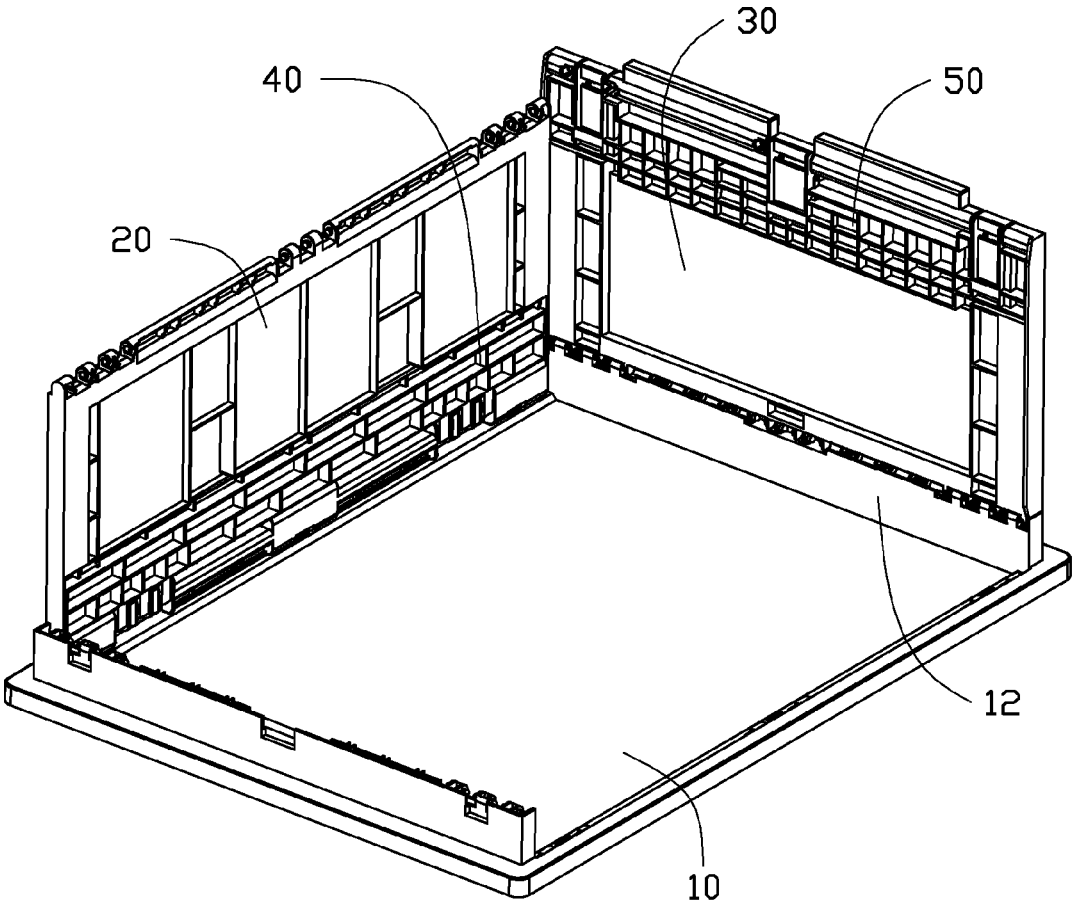
FIG. 11 is a partial view of FIG. 10.
Figure 12:
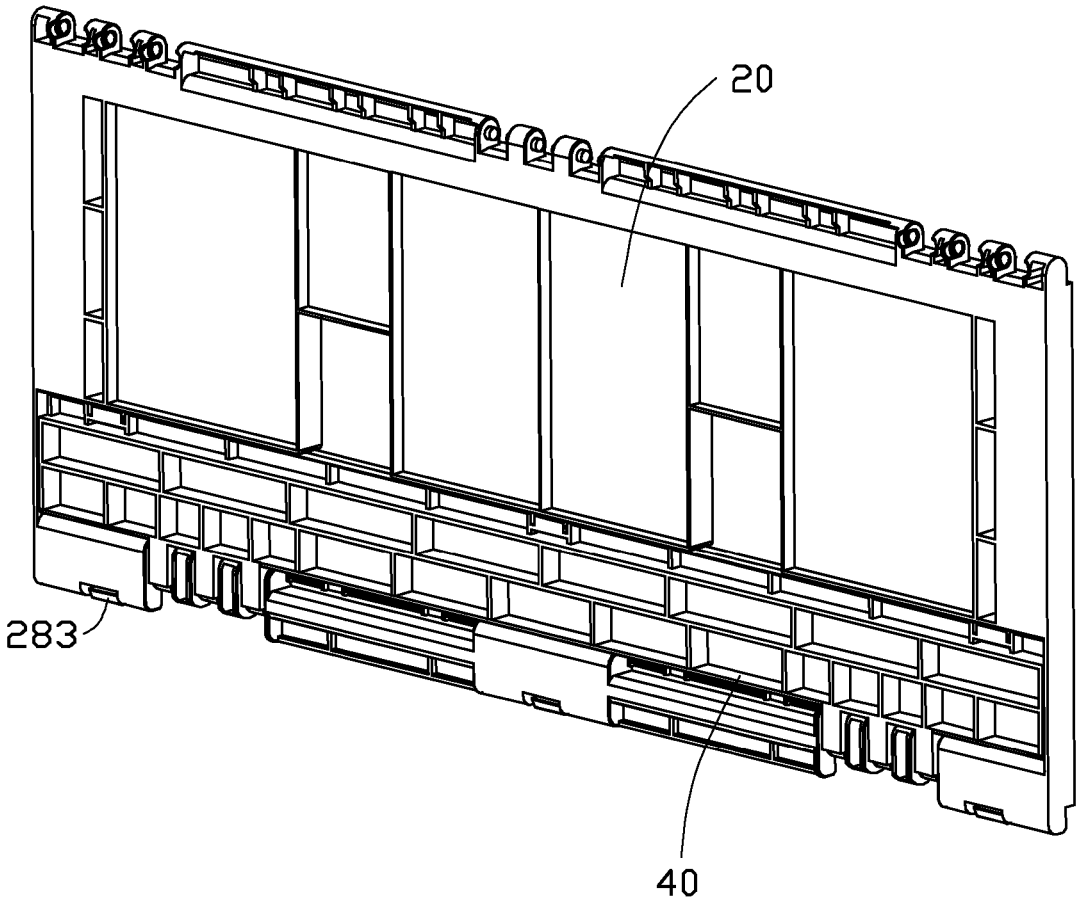
FIG. 12 is an assembled view of one of the first folding board sets shown in FIG. 1, showing a folded state of the first folding board set.
Figure 13:
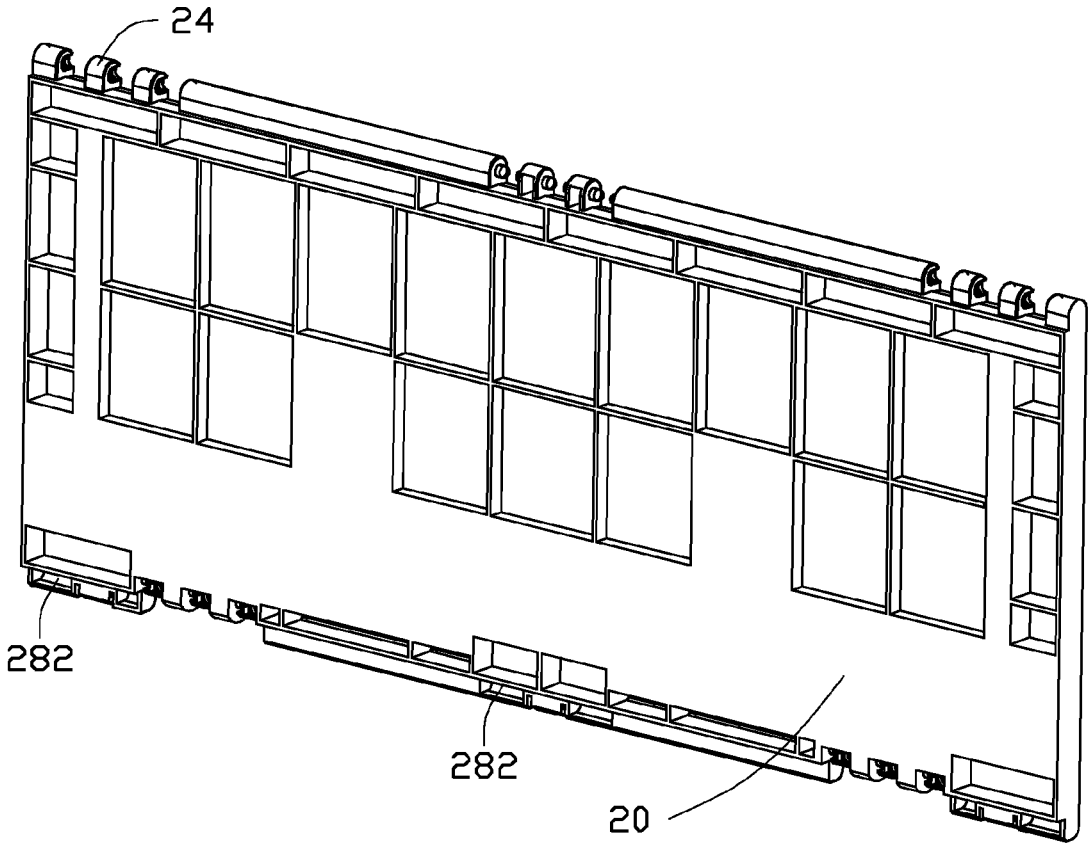
FIG. 13 is similar to FIG. 12, but viewed from another perspective.

Referring to FIG. 8 and FIG. 9, in assembly, the pins 221 are pivotably inserted in the corresponding pivot holes 422, to pivotably connect the bottom side of each first side plate 20 to the top side of the corresponding first assistant plate 40. The pins 521 are pivotably inserted in the corresponding pivot slots 362, to pivotably connect the bottom side of each second assistant plate 50 to the top side of the corresponding second side plate 30.

The pins 1211 are pivotably inserted in the pivot holes 321, to pivotably connect the bottom sides of the second side plate 30 to the mounting plates 12, respectively. The pins 6231 are pivotably inserted in the pivot holes 242 to pivotably connect the locking portions 623 to the second pivot portions 24 alternately. Thus the top sides of the first side plates 20 are pivotably coupled to the inner sides of the first sidewalls 62.

The second folding board sets are operated to be uprightly stand on the bottom board 10. The mounting frame 60 is pulled up to pull up the first folding board sets together with the mounting frame 60, until the blocks 642 are locked to the first locking slots 54 respectively. The bottom sides of the first assistant plates 40 are then pressed to be respectively positioned to the flanges 14 through the blocking pieces 1431 respectively inserting in the slots 442 and each block 441 being blocked between the corresponding blocking surface 142 and the corresponding block 1432. Thus the first and second folding board sets and the bottom board 10 together form a box with a first height, and the mounting frame 60 is mounted to the tops of the first and second folding board sets. The first folding board sets are sandwiched between the second folding board sets.

Referring to FIG. 10 to FIG. 13, when assembling the box to a second height state, the second assistant plates 50 are rotated to be received in the receiving spaces 38 respectively, with the pivot portions 52 being rotated to make the second locking slots 56 face out. The first assistant plates 40 are rotated to be received in the receiving spaces 271 respectively. The second side plates 30 are operated to uprightly stand on the bottom board 10. The mounting frame 60 is pulled up to pull up the first folding board sets together with the mounting frame 60, until the blocks 642 are locked to the second locking slots 56 respectively. The bottom sides of the first side plates 20 are then pressed to be respectively fixed to the flanges 14 through the blocking pieces 1431 respectively inserting in the slots 282 and each block 283 being blocked between the corresponding blocking surface 142 and the corresponding block 1432. Thus the first side plates 20, the second side plates 30, and the bottom board 10 together form a box with a second height.

Figure 14:
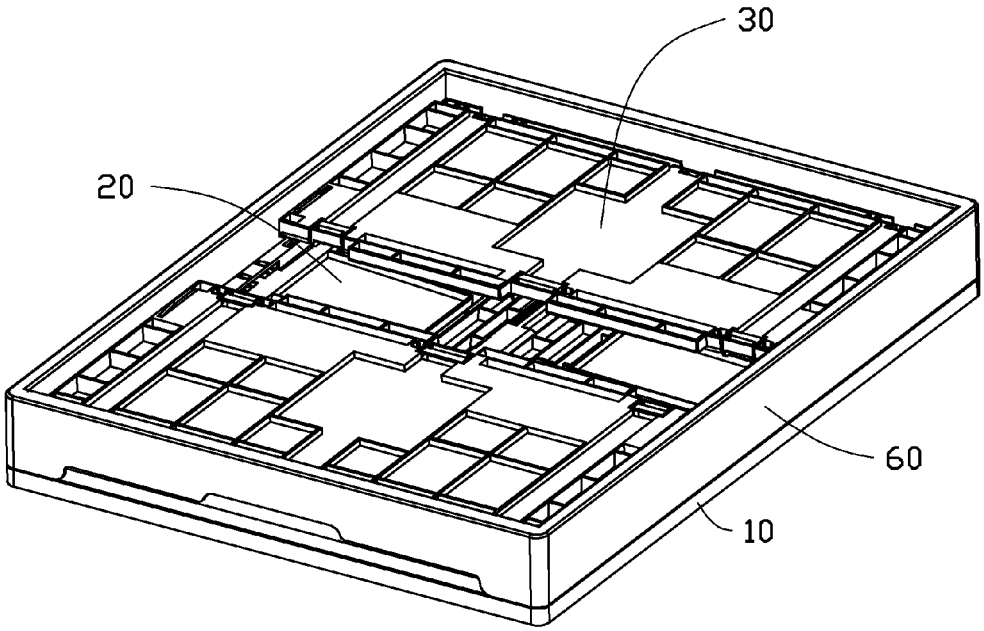
FIG. 14 is an isometric view of FIG. 1, showing a folded state.
Figure 15:
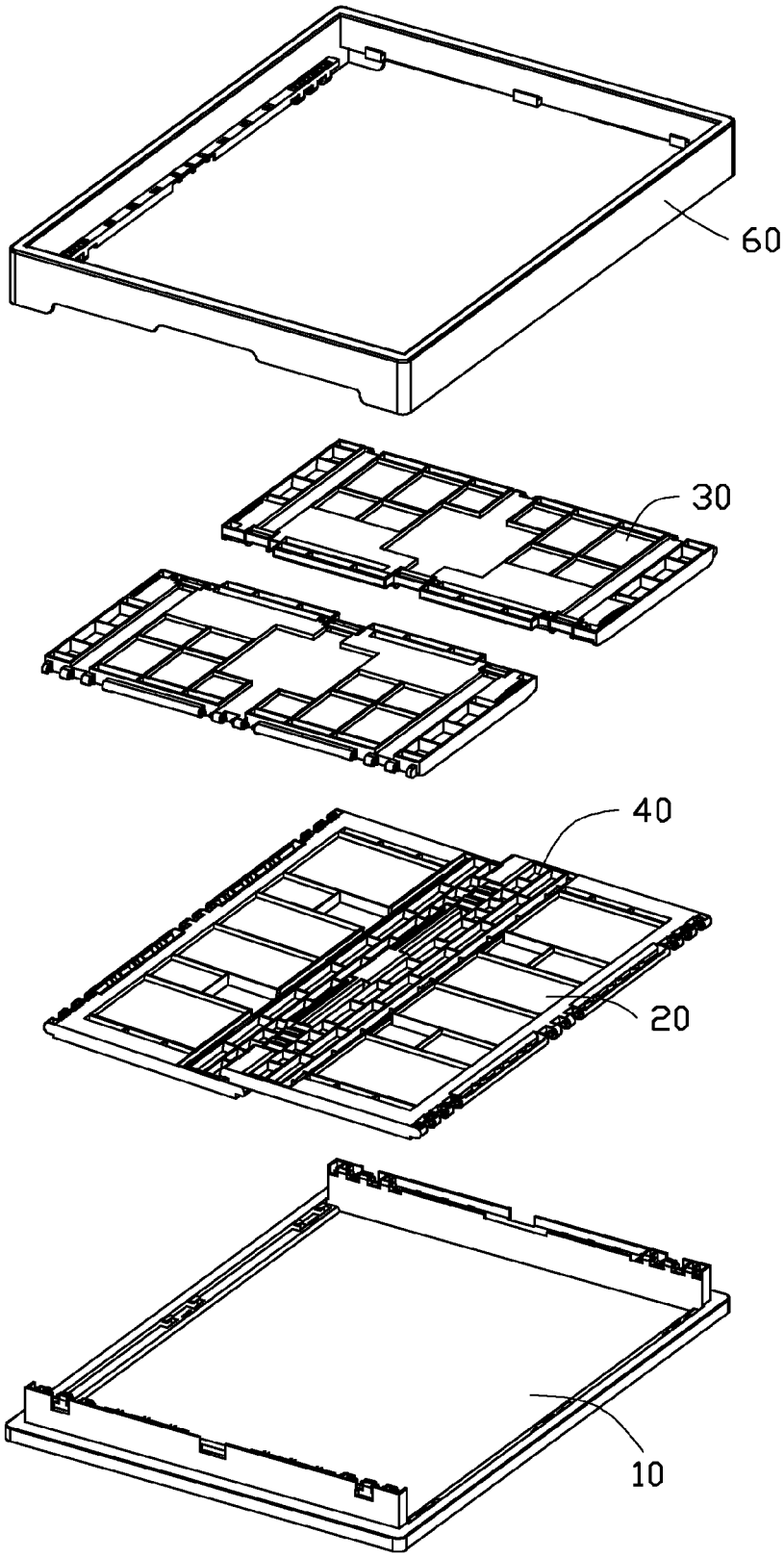
FIG. 15 and FIG. 16 are partially exploded, isometric views of the folded folding box shown in FIG. 8, but viewed from two different perspectives.
Figure 16:
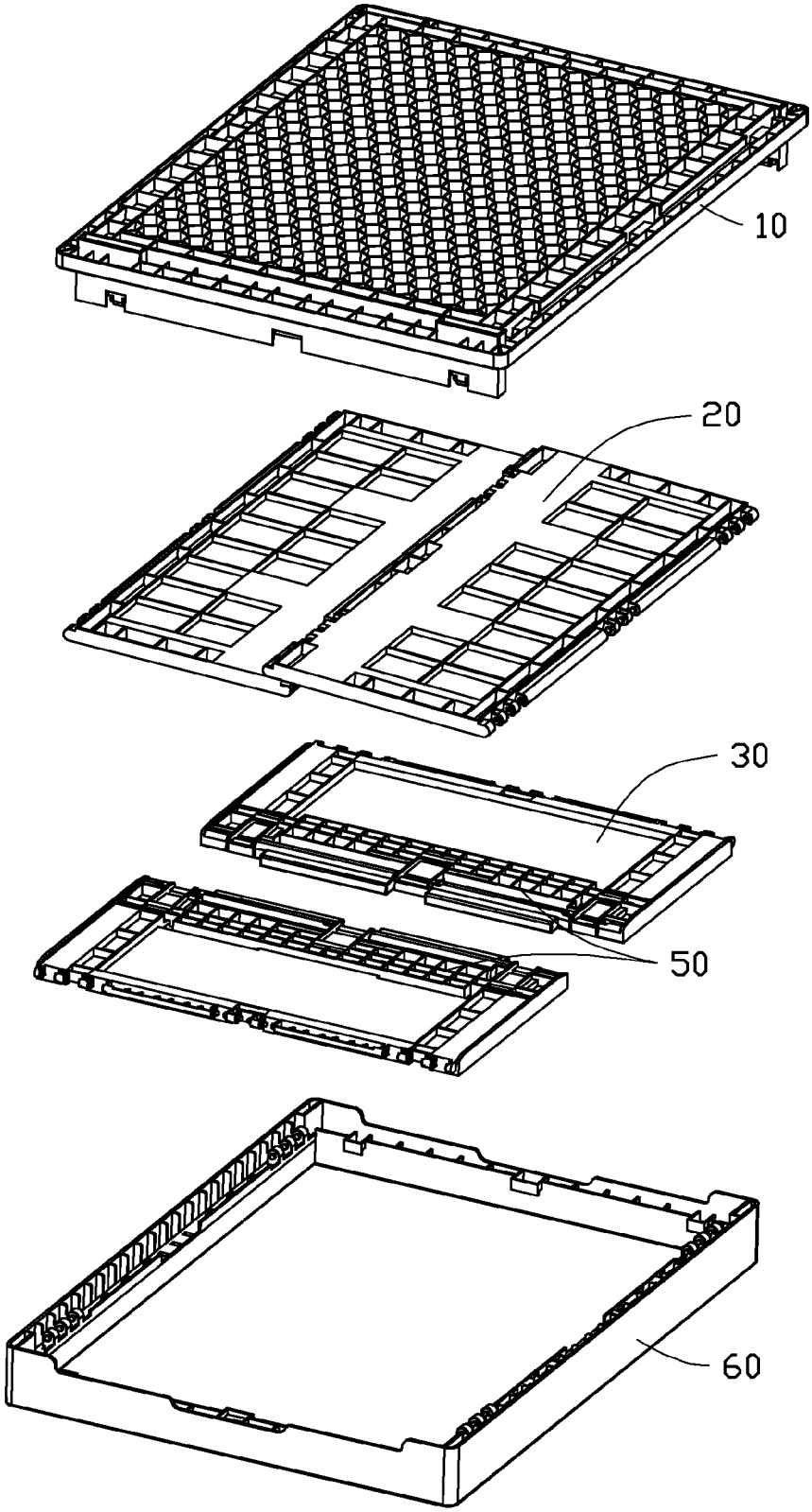

Referring to FIG. 14 to FIG. 16, when folding the box from the second height state, the bottom sides of the first side plates 20 are pressed toward each other, until the bottom sides of the first side plates 20 are released from the flanges 14 respectively. The top sides of the second side plates 30 are pressed toward each other to release the blocks 642 from the second locking slots 56. The mounting frame 60 then falls down to stack on the bottom board 10. During the mounting frame 60 falling down, the bottom sides of the first side plates 20 slide to a middle portion of the bottom board 10, until the first side plates 20 are stacked on the bottom board 10. The second side plates 30 are rotated to be stacked on the first side plates 20. Thus the box is folded.

In the embodiment, when in use, the box can be transformed to two different height states to storage goods. When not in use, the folding box 100 can be folded for easy packing and transporting.

It is to be understood, however, that even though numerous characteristics and advantages of the embodiments have been set forth in the foregoing description, together with details of the structure and function of the embodiments, the disclosure is illustrative only, and changes may be made in detail, especially in the matters of shape, size, and arrangement of parts within the principles of the disclosure to the full extent indicated by the broad general meaning of the terms in which the appended claims are expressed.

What is claimed is:

1. A folding box, comprising:

a bottom board comprising two opposite first sides, and two opposite second sides connected between the first sides;

two first folding board sets opposite to each other, each first folding board set comprising a first upper folding board and a first lower folding board pivotably coupled to each other;

two second folding board sets opposite to each other, each second folding board set comprising a second upper folding board and a second lower folding board pivotably coupled to each other; and a mounting frame comprising two opposite first sidewalls, and two opposite second sidewalls connected between the first sidewalls;

wherein a bottom side of each of the second lower folding boards of the second folding board sets is pivotably coupled to a corresponding one of the second sides of the bottom board, each of the first folding board sets is connected between a corresponding one of the first sidewalls of the mounting frame and a corresponding one of the first sides of the bottom board, and sandwiched between the second folding board sets;

wherein to adjust a height of the folding box to receive something, the first upper folding board and the corresponding first lower folding board are folded to each other, the second upper folding board and the corresponding second lower folding board are folded to each other;

wherein the bottom sides of the first upper folding boards of the first folding board sets are lockable to the opposite first sides of the bottom board respectively, the top sides of the second lower folding boards of the second folding board sets are lockable to the opposite second sidewalls of the mounting frame respectively; and wherein at least two pivot portions are formed from two opposite ends of the bottom side of each second upper folding board of the second folding board sets, to be pivotably connected to the top sides of the corresponding second lower folding board of the second folding board sets, a first locking slot is defined in each second upper folding board of the second folding board sets, a second locking slot is defined in one of the pivot portions of each second upper folding board of the second folding board sets, a block is formed on an inner side of each second sidewall of the mounting frame, the blocks are lockable to the first locking slots respectively, when the second upper folding boards of the second folding board sets are folded to the second lower folding boards of the second folding board sets respectively, the at least two pivot portions are rotated out to make the second locking slots face out, the blocks are lockable to the second locking slots respectively.

2. The folding box of claim 1, wherein top sides of the first upper folding boards of the first folding board sets are pivotably coupled to the first sidewalls of the mounting frame respectively, bottom sides of the first lower folding boards of the first folding board sets are releasably locked to the opposite first sides of the bottom board respectively.

3. The folding box of claim 2, wherein when in use, the mounting frame is pulled up, the bottom sides of the first lower folding boards of the first folding board sets are locked to the opposite first sides of the bottom board respectively, top sides of the second upper folding boards of the second folding board sets are locked to the opposite second sidewalls of the mounting frame respectively.

4. The folding box of claim 3, wherein when not in use, the bottom edges of the first lower folding boards of the first folding board sets are released from the opposite first sides of the bottom board respectively, the top edges of the second upper folding boards of the second folding board sets are released from the opposite second sidewalls of the mounting frame, the mounting frame then falls down to stack on the bottom board, the first folding board sets are folded and stacked on the bottom board, the second folding board sets are folded and stacked on the first folding board sets.

5. The folding box of claim 1, wherein the first upper folding boards of the first folding board sets each define a first receiving space for receiving the corresponding first lower folding boards of the first folding board sets, the second lower folding boards of the second folding board sets each define a second receiving space for receiving the corresponding second upper folding boards of the second folding board sets.

6. The folding box of claim 1, wherein the bottom sides of each of the first upper folding boards and the first lower folding boards of the first folding board sets each form a first mounting unit, a second mounting unit is formed from each first side of the bottom board, for selectively locked to the corresponding first mounting unit.

7. The folding box of claim 1, wherein two mounting plates extend from the second sides, the second lower folding boards of the second folding board sets are pivotably connected to the mounting plates.

8. A folding box, comprising:

a bottom board comprising two opposite first sides, and two opposite second sides connected between the first sides;

two first folding board sets opposite to each other, each first folding board set comprising a first upper folding board and a first lower folding board pivotably coupled to each other;

two second folding board sets opposite to each other, each second folding board set comprising a second upper folding board and a second lower folding board pivotably coupled to each other; and a mounting frame comprising two opposite first sidewalls, and two opposite second sidewalls connected between the first sidewalls;

wherein top sides of the upper folding boards of the first folding board sets are pivotably coupled to the first sidewalls of the mounting frame respectively, bottom sides of the lower folding boards of the second folding board sets are pivotably coupled to the second sides of the bottom board;

wherein, when in use, the mounting frame is pulled up, bottom sides of the first lower folding boards of the first folding board sets are locked to the opposite first sides of the bottom board respectively, top sides of the second upper folding boards of the second folding board sets are locked to the opposite second sidewalls of the mounting frame respectively;

wherein when not in use, the bottom sides of the first lower folding boards of the first folding board sets are released from the opposite first sides of the bottom board respectively, the top sides of the second upper folding boards of the second folding board sets are released from the opposite second sidewalls of the mounting frame, the mounting frame then falls down to stack on the bottom board, the first folding board sets are folded and stacked on the bottom board, the second folding board sets are folded and stacked on the first folding board sets;

wherein to adjust a height of the folding box to receive something, the first upper folding board and the corresponding first lower folding board are folded to each other, the second upper folding board and the corresponding second lower folding board are folded to each other;

wherein bottom sides of the first upper folding boards of the first folding board sets are lockable to the opposite first sides of the bottom board respectively, top sides of the second lower folding boards of the second folding board sets are lockable to the opposite second sidewalls of the mounting frame respectively; and wherein at least two pivot portions are formed from two opposite ends of a bottom side of each second upper folding board of the second folding board sets, to be pivotably connected to the top sides of the corresponding second lower folding board of the second folding board sets, a first locking slot is defined in each second upper folding board of the second folding board sets, a second locking slot is defined in one of the pivot portions of each second upper folding board of the second folding board sets, a block is formed on an inner side of each second sidewall of the mounting frame, the blocks are lockable to the first locking slots respectively, when the second upper folding boards of the second folding board sets are folded to the second lower folding boards of the second folding board sets respectively, the at least two pivot portions are rotated out to make the second locking slots face out, the blocks are lockable to the second locking slots respectively.

9. The folding box of claim 8, wherein the first upper folding boards of the first folding board sets each define a receiving space for receiving the corresponding first lower folding boards of the first folding board sets, the second lower folding boards of the second folding board sets each define a receiving space for receiving the corresponding second upper folding boards of the second folding board sets.

10. The folding box of claim 8, wherein the bottom sides of each of the first upper folding boards and the first lower folding boards of the first folding board sets each form a first mounting unit, a second mounting unit is formed from each first side of the bottom board, for selectively locked to the first mounting unit.

11. The folding box of claim 8, wherein two mounting plates extend from the second sides, the second lower folding boards of the second folding board sets are pivotably connected to the mounting plates.

* * * * *